US006817326B1

(12) United States Patent
Anibas

(10) Patent No.: US 6,817,326 B1
(45) Date of Patent: Nov. 16, 2004

(54) VALVE SYSTEM FOR INTERNAL COMBUSTION ENGINES

(76) Inventor: Kevin J. Anibas, 2136 4th St., Eau Claire, WI (US) 54703

( * ) Notice: Subject to any disclaimer, the term of this patent is extended or adjusted under 35 U.S.C. 154(b) by 0 days.

(21) Appl. No.: 10/664,332

(22) Filed: Sep. 22, 2003

(51) Int. Cl.[7] ..... F01L 1/34
(52) U.S. Cl. ..... 123/90.16; 123/90.29
(58) Field of Search ..... 123/90.23, 90.28, 123/58.9, 90.16

(56) References Cited

U.S. PATENT DOCUMENTS

| | | | | |
|---|---|---|---|---|
| 556,195 | A | | 3/1896 | Mellars |
| 1,007,491 | A | | 10/1911 | Reynolds |
| 1,131,707 | A | | 3/1915 | Johnson |
| 1,172,871 | A | | 2/1916 | Cobb |
| 1,211,604 | A | | 1/1917 | Lewis |
| 1,241,662 | A | | 10/1917 | Ronconi |
| 1,274,300 | A | | 7/1918 | McInturff |
| 1,363,363 | A | | 12/1920 | Sinclair |
| 1,698,040 | A | | 1/1929 | White |
| 1,707,086 | A | | 3/1929 | Kuske |
| 1,877,760 | A | | 9/1932 | Berner et al. |
| 1,903,802 | A | | 4/1933 | Agerell |
| 1,907,214 | A | | 5/1933 | Nyquist |
| 1,923,666 | A | | 8/1933 | French |
| 2,409,350 | A | | 10/1946 | Forrest |
| 2,741,931 | A | | 4/1956 | Sills |
| 4,113,268 | A | * | 9/1978 | Simmons et al. ..... 277/641 |
| 4,309,966 | A | * | 1/1982 | Klomp ..... 123/90.28 |
| 4,739,968 | A | | 4/1988 | Schabinger |
| 4,765,287 | A | | 8/1988 | Taylor et al. |
| 5,040,498 | A | | 8/1991 | Scherer |
| 5,503,130 | A | | 4/1996 | Pomeisl |
| 5,647,307 | A | | 7/1997 | Clarke et al. |
| 5,694,890 | A | * | 12/1997 | Yazdi ..... 123/58.9 |
| 5,931,134 | A | | 8/1999 | Kudryashov |
| 6,105,542 | A | | 8/2000 | Efford |
| 6,196,180 | B1 | * | 3/2001 | Higashi et al. ..... 123/193.3 |

* cited by examiner

*Primary Examiner*—Thomas Denion
*Assistant Examiner*—Zelalem Eshete
(74) *Attorney, Agent, or Firm*—Tipton L. Randall

(57) ABSTRACT

Disclosed is a valve system that provides a means of controlling the charging and exhausting of the combustion chamber(s) of internal combustion engines. In this system, asymmetrical valve bodies are first lifted a nominal distance from their sealing surfaces, then are rotated by their non-centered stems, which operate in conventional valve guides. Rapid port opening, relatively long duration at the full open position, and rapid port closing are achieved. This dual-action valve motion is provided by a drum type camshaft featuring radial protrusions to lift the valves from their sealing surfaces and circumferential cam grooves, which rotate the valves in palindromic fashion. A multi-level valve layout allows for relatively larger port sizes, as it lets the valves move without interference with one another. A mechanism for actuating the valves by electromechanical means is also disclosed.

16 Claims, 8 Drawing Sheets

VALVE SYSTEM FOR INTERNAL COMBUSTION ENGINES

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention is a valve system for controlling the charging and exhausting of the combustion chamber(s) of internal combustion engines.

2. Background Information

This invention applies to charging and exhausting the combustion chamber(s) of internal combustion engines in an efficient manner.

Four stroke-cycle engines of common design breathe through two or more concentric poppet valves featuring angled seating areas. While modern engines have become much more efficient than previous examples by the incorporation of smaller included valve angles, increased valve area, and better port design, poppet valves by nature mask the ports which they control. In essence, the gas flow into and out of the combustion chamber must go around the head of the open valve(s) to proceed through the port(s). This limits the volumetric efficiency of the engine. These valves are opened by radial lobes of a rotating camshaft. The base diameter of the camshaft lobes is largely dictated by the design valve lift, as the camshaft must ramp the valves open and closed smoothly, and at the proper time. To fit the timing constraints, the valves are ramped to full open, then ramped closed with essentially no duration at the fill open position. To maintain smooth and properly timed valve actuation, significant increases in cam lobe base diameter are not possible with poppet valves. With the exception of desmodromic designs, high-rate springs are used to make the valves follow the profile of the camshaft lobes. These strong springs are required to control valve float at elevated engine speeds. Valve float causes the engine to run erratically, or even causes the valve(s) to destructively collide with the cylinder's piston. Each time the valves are opened, energy is expended to overcome the tension of the valve springs. The high spring tension also forces more robust design in related valve-train components. Known attempts to overcome these problems generally have had lubrication, oil control, and/or sealing issues.

Applicant has invented a valve system which lessens valve-port masking, opens the ports rapidly, has relatively long filly open duration, and also closes the ports rapidly. This system does not require that long-travel, high-rate springs be compressed. The asymmetrical valves of this system are palindromically controlled, and destructive valve float is eliminated. There is no unlubricated sliding or rotating motion, and oil control is the same as in conventional designs. A relatively larger diameter camshaft allows more precise valve actuation. The absence of long-travel, high-rate springs provides for the option of using electromechanical actuators in place of the camshaft.

SUMMARY OF THE INVENTION

The invention is a valve system to control the charging and exhausting of combustion chamber fluids of internal combustion engines. The valve system includes a cylinder head adapted for securing to a multi-level combustion chamber, the cylinder head including asymmetrical ports which open into the combustion chamber on separate levels. Each port is controlled by a valve member larger than the port, the valve member of similar shape as the port, each valve member providing a flat sealing area for contacting the port periphery. Each valve member has a non-centered cylindrical stem operatively traveling in a cylindrical valve guide sealed by a valve guide seal, each valve stem protruding through an end of the valve guide opposite the combustion chamber to locate a valve spring and accept a follower which captures the valve spring. Each follower is operatively associated with a valve operating assembly to selectively provide axial movement and rotational movement to each valve member and valve stem. The valve operating assembly first moves the valve member a nominal distance from the port periphery to unseal the port, then rotates the valve member in one direction to open the associated port, next rotates the valve member in an opposite direction to close the associated port, and finally moves the valve member a nominal distance to contact the port periphery and seal the port.

One embodiment of the valve system includes a specially designed cylinder head with two or more asymmetrical valve members with valve bodies shaped as needed to provide sufficient port area for the particular application. These valve members have conventional cylindrical stems which are offset from the center of the valve's body. The valve member's cover ports are shaped to match the valve's shape, with the ports somewhat smaller to provide a flat sealing surface completely around their periphery. Optionally, a matching seal, larger than the port, but smaller than the valve body, may be fitted to the sealing area. The valve stems travel in conventional valve guides which are machined or pressed into the cylinder head, and which are sealed by conventional valve guide seals. The one embodiment of the valve system function as follows. A radial protrusion on an overhead camshaft, rotating at one-half crankshaft rpm, overcomes a valve spring and lifts the valve member a nominal distance off its sealing surface. Next, a circumferential groove on the camshaft acting on a follower, rotates the valve body to open the port, then rotates the valve member back to its original position to close the port. Once the valve member is back in its original position, the radial protrusion lowers the valve member back to its seated position. The camshaft diameter is not dictated by design valve lift and can be relatively larger to achieve desired valve member motion. A multi-level combustion. chamber allows relatively larger valve and port area. The valve members can be larger than conventional designs, because they operate on different planes and don't interfere with each others path. In this design, the ports are oriented such that the valve guides are in line parallel with the crankshaft, allowing the use of a single camshaft driven by a simple chain or gear belt. Other designs with more valve members and multiple camshafts are possible, including separate camshafts for lift and for rotation.

In another embodiment of the invention, the camshaft(s) is replaced with electromechanical actuators. This is possible as the present invention features minimal valve spring force to overcome, as compared with conventional designs. In this embodiment, separate actuators for lift and for rotation open and close each valve member. The actuators can be solenoids, or solenoid controlled pneumatic cylinders. In the case of pneumatic actuation, air pressure is supplied by a pump powered by the engine and by a reservoir. Also, in this embodiment, continuously variable valve timing is provided by a control module acting on inputs such as crankshaft rpm, throttle position, inlet tract vacuum and other operating parameters. The present invention is described for a single cylinder engine design. The valve system is also applicable to multi-cylinder engines.

DESCRIPTION OF THE EMBODIMENTS

Nomenclature

1 Cylinder Head
2 Valve Guide
3 Valve Guide Seal
4 Valve Stem
5 Camshaft Bearing
6 Tubular Spark Plug Cavity
7 Valve Spring
8 Follower
9 Camshaft Assembly
10 Camshaft Drive Sprocket
11 Camshaft Bearing Cap
12 Inlet Valve Member
13 Exhaust Valve Member
14 Threaded Spark Plug Hole
15 Inlet Port
16 Exhaust Port
17 Valve Seating Area
18 Opening for Camshaft Drive Chain or Belt
19 Camshaft Shaft
20 Camshaft Cam Segment
21 Circumferential Camshaft Groove
22 Radial Camshaft Protrusion
23 Follower Driven Pin
24 Follower Valve Stem Hole
25 Flat on Valve Stem
26 Exhaust Port Seal
27 Inlet Port Seal
28 Port Seal Groove
29 Follower Setscrew
30 Cam Segment Setscrew
31 Valve Lift Actuator
32 Valve Rotation Actuator Construction Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 4:
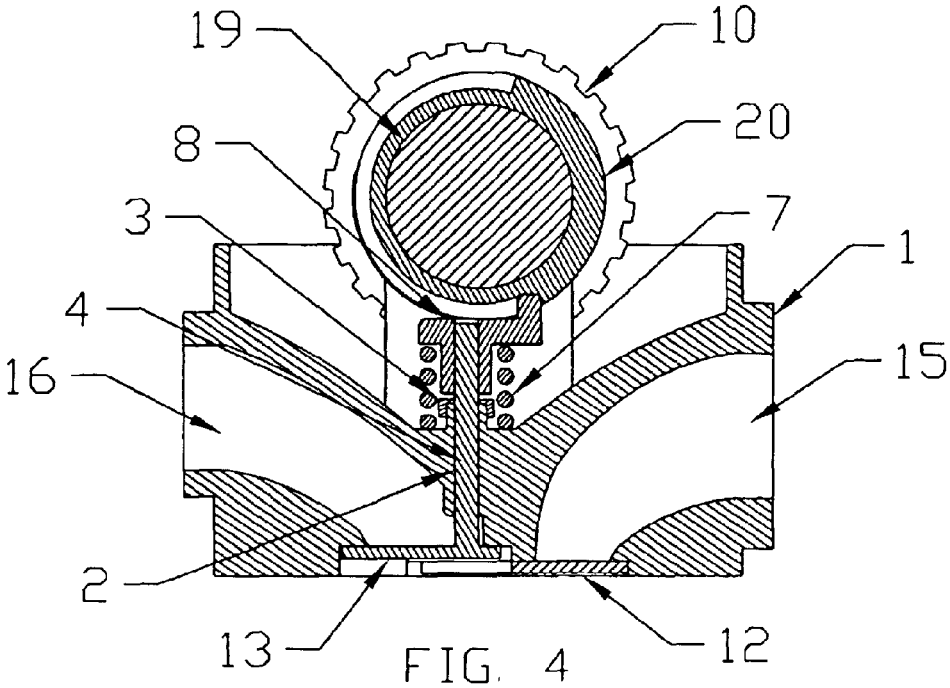
FIG. 4 is a section view of the assembly which shows the valves seated at different levels, the ports, a valve guide, valve guide seal, valve spring, follower, and camshaft assembly with a circumferential groove.
Figure 3:
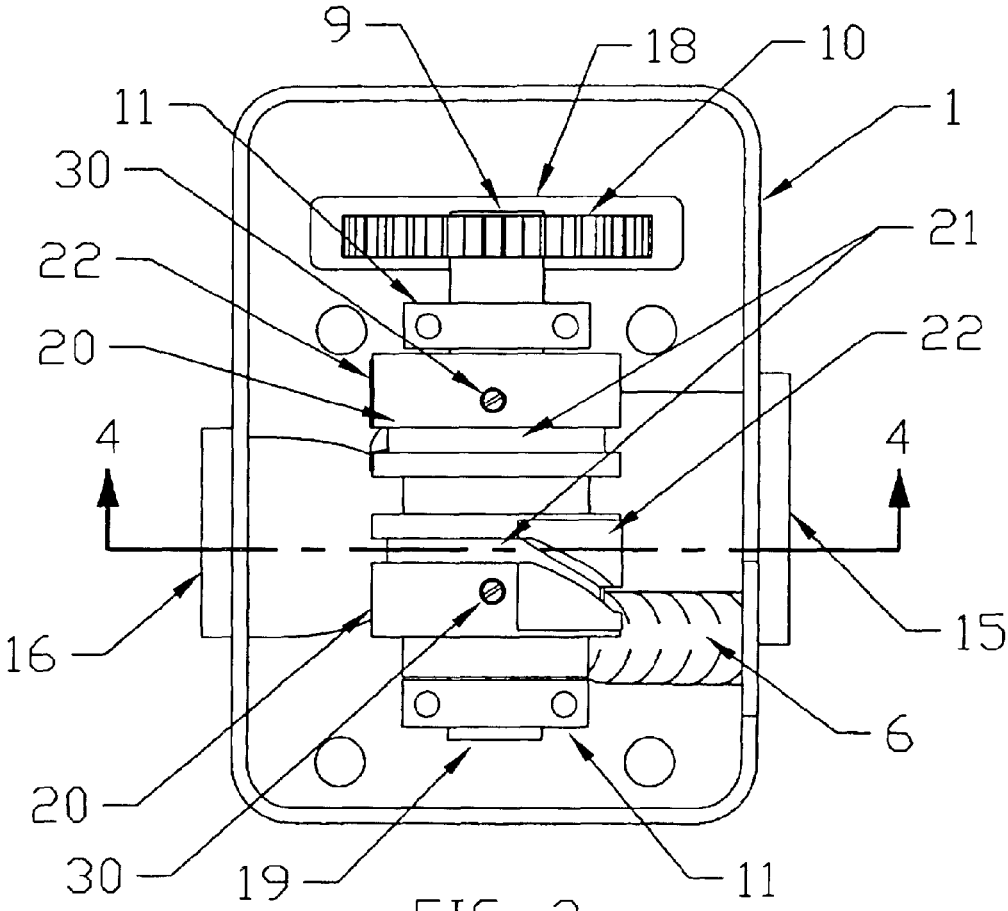
FIG. 3 is a plan view of the invention which shows the outside of the tubular spark plug cavity, the camshaft assembly, and the section line for FIG. 4.
Figure 8:
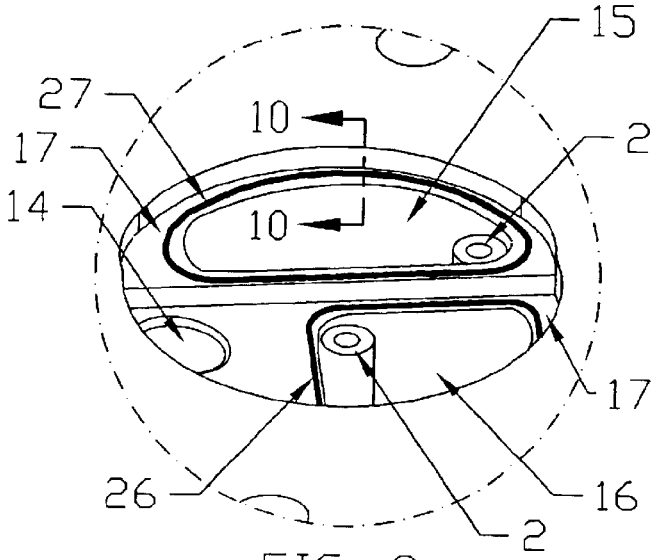
FIG. 8 is an enlarged perspective view of the combustion chamber with valves removed showing the port seals which may be used in this invention.
Figure 7:
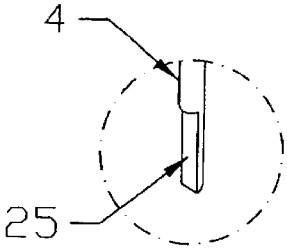
FIG. 7 is an enlarged perspective view of a valve stem showing the flat which registers the follower to the stem.
Figure 6:
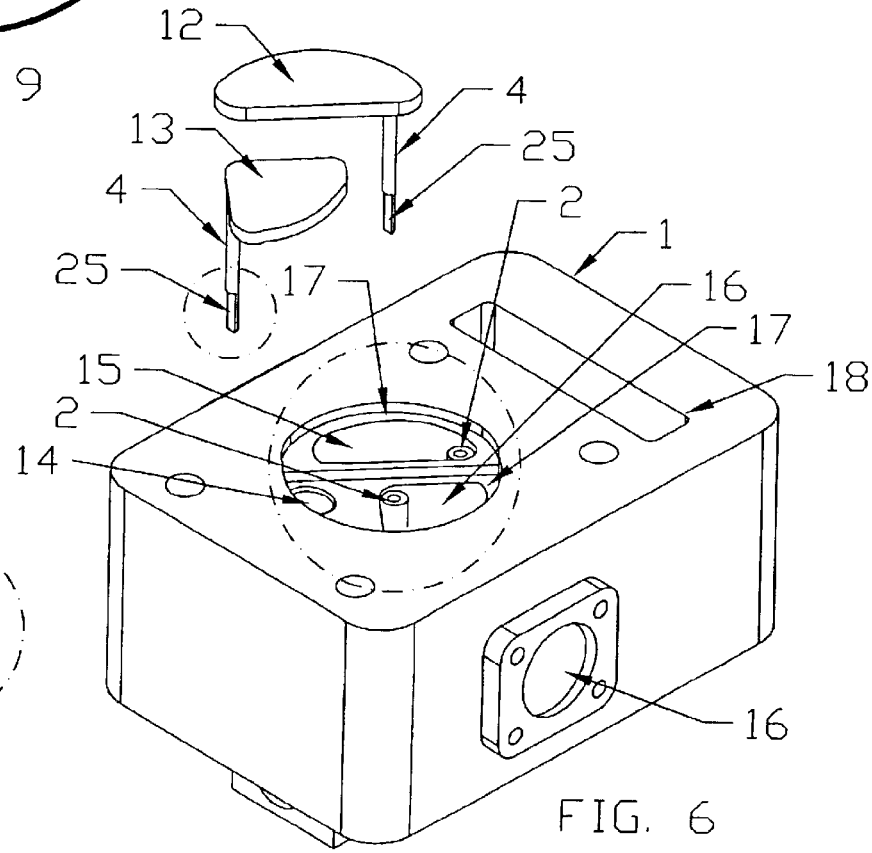
FIG. 6 is an exploded perspective view of the bottom of the cylinder head and valves, and shows the combustion chamber.
Figure 11:
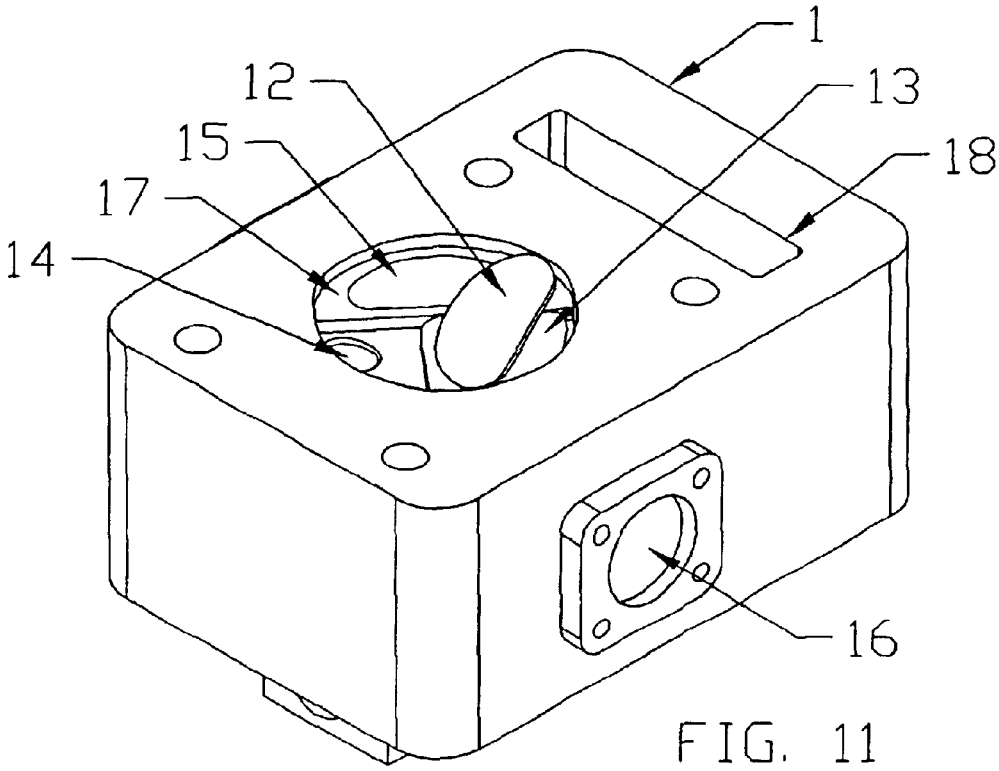
FIG. 11 is a perspective view of the bottom of the invention showing the combustion chamber with the inlet valve in the fully open position and the exhaust valve fully closed.
Figure 12:
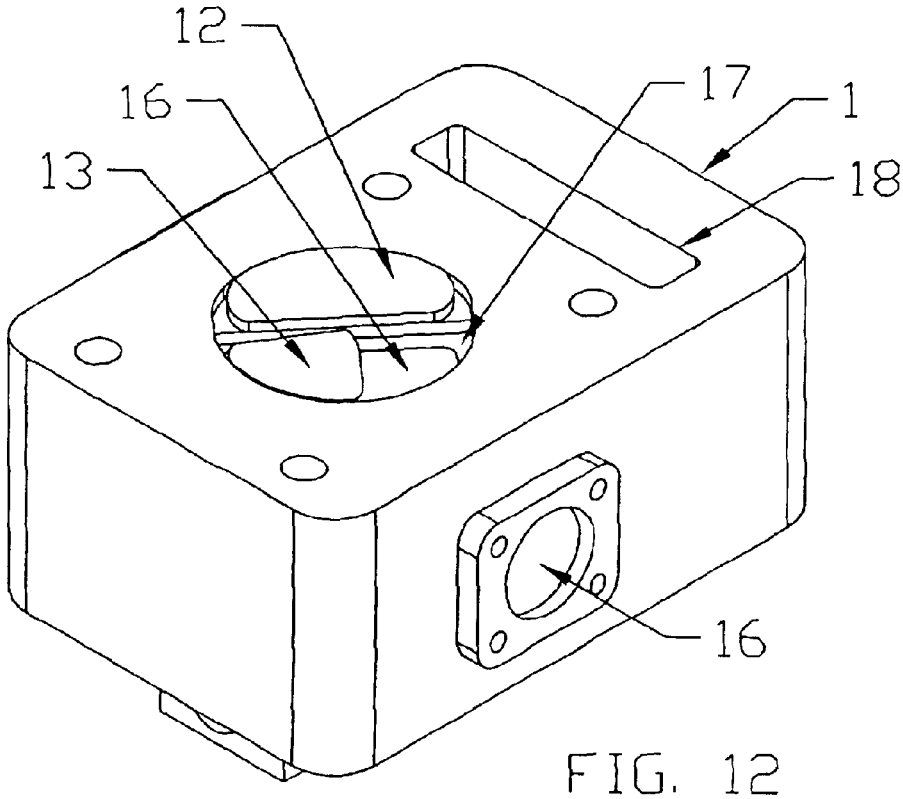
FIG. 12 is a perspective view of the bottom of the invention showing the combustion chamber with the exhaust valve in the fully open position and the inlet valve fully closed.
Figure 17:
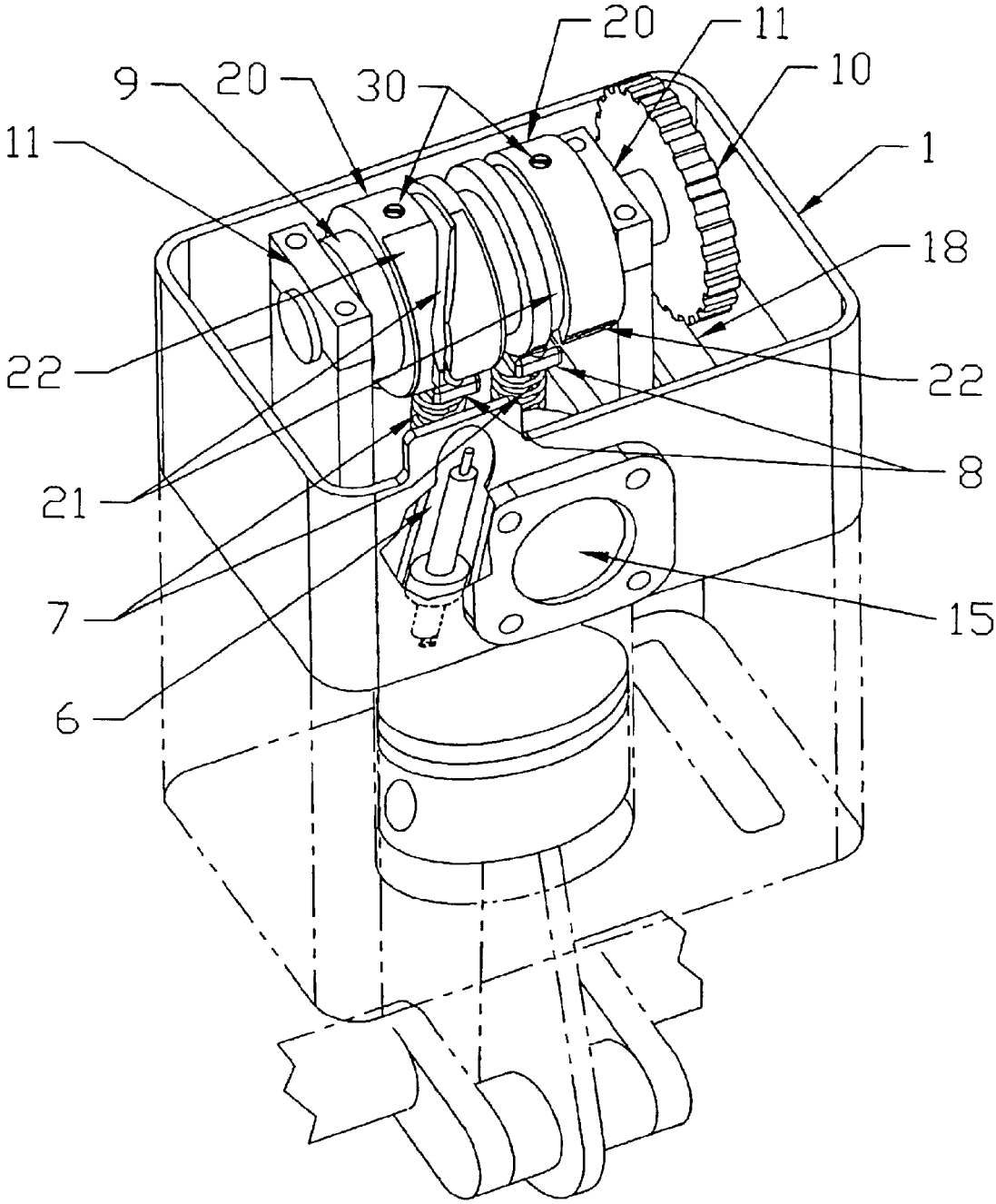
FIG. 17 is a perspective view of one embodiment of the invention mounted to a cylinder block of an engine, the spark plug shown in a cutaway portion of the cylinder head.

The invention is a mechanical assembly that includes a specially designed cylinder head 1 with a multi-level combustion chamber (FIGS. 4 and 8). A tubular spark plug cavity 6 opens to the outside of the cylinder head 1 and terminates in a threaded spark plug hole 14 in the attached combustion chamber. This tubular spark plug cavity 6 and threaded hole 14 accepts a spark plug (FIG. 17) and isolates the plug from the inside of the cylinder head 1 to protect the plug from the engine lubricant which is prevalent in that area.

Figure 1:
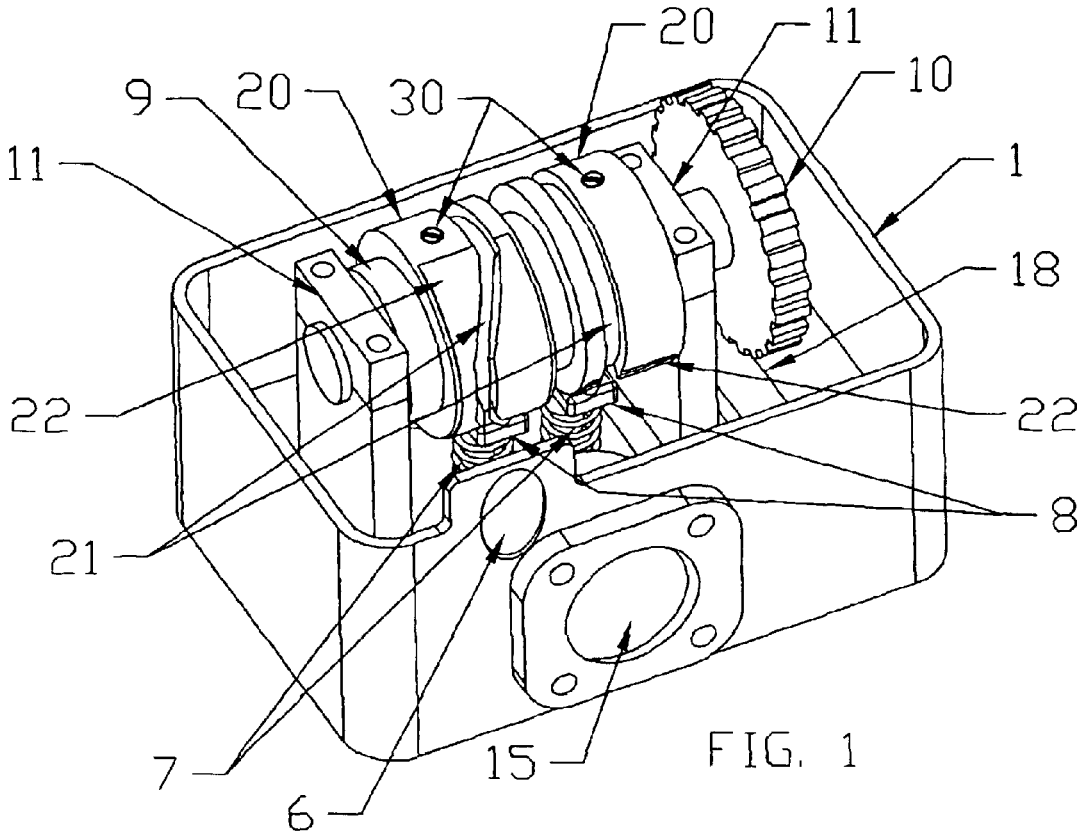
FIG. 1 is a perspective view of the top of the invention showing the camshaft assembly and other features.
Figure 2:
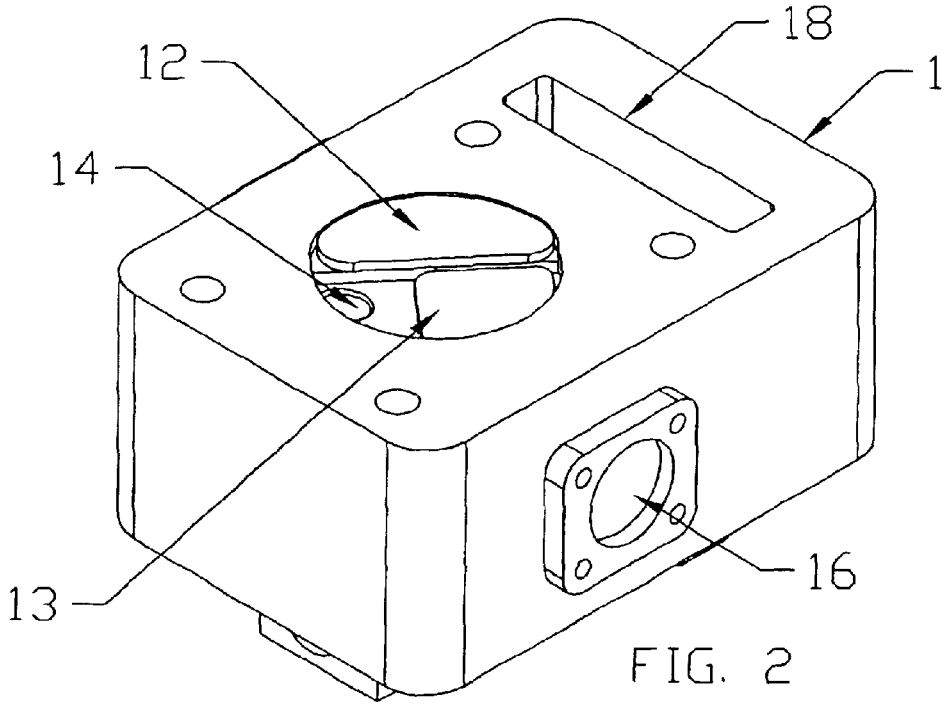
FIG. 2 is a perspective view of the bottom of the invention showing the combustion chamber and valves.
Figure 5:
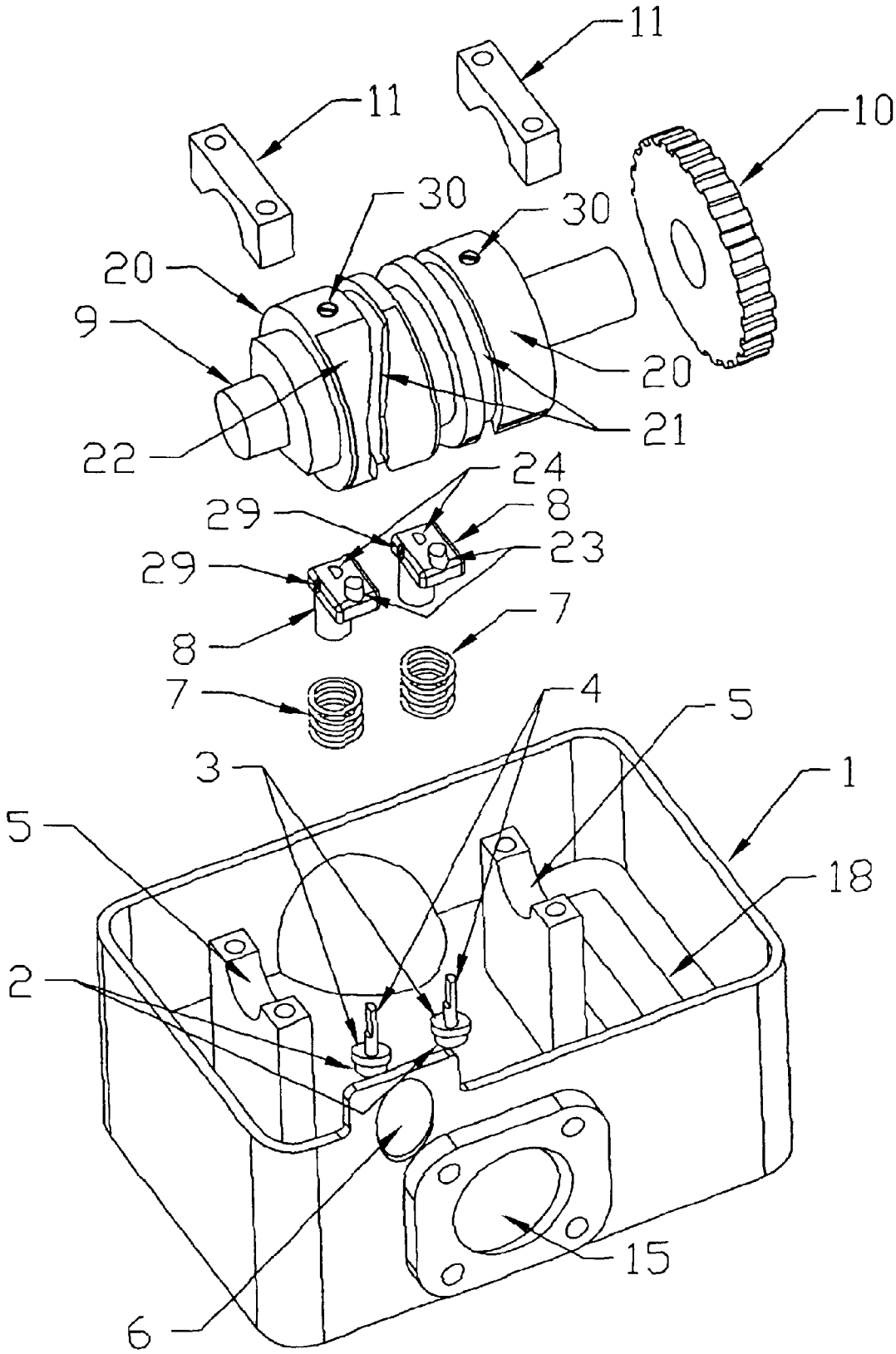
FIG. 5 is an exploded perspective view of the top of the invention.
Figure 10:
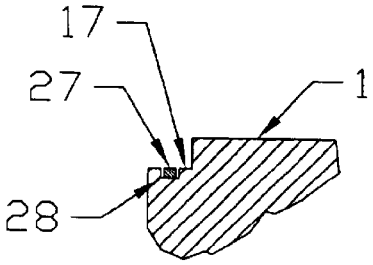
FIG. 10 is a section view of the valve seating area with a valve seal installed in a valve seal groove.
Figure 9:
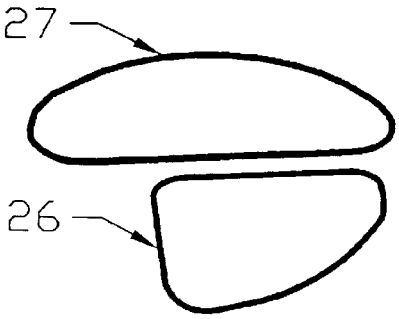
FIG. 9 is a perspective view of the inlet and exhaust port seals which may be used in this invention.

An asymmetrical inlet port 15 and an asymmetrical exhaust port 16 open onto separate levels of the combustion chamber, best seen in FIG. 4. The inlet port 15 is covered and controlled by an inlet valve member 12 which is the same shape as the port 15, but which is somewhat larger so that the valve member 12 seats on a flat valve seating area 17 extending completely around the periphery of the port 15. The exhaust port 16 is covered and controlled by an exhaust valve member 13 which is the same shape as the port 16, but which is somewhat larger so that the valve member 13 seats on a flat valve seating area 17 extending completely around the periphery of the port 16. An exhaust port seal 26 and an inlet port seal 27 may be fitted to the valve seating area 17, as shown in FIG. 8. These seals 26, 27 may be applied to the surface of the valve seating area 17 or may be fitted into a port seal groove 28 which is the same shape as the port, but is somewhat larger than the periphery of the port, as shown in FIG. 10. The inlet valve member 12 and exhaust valve member 13 feature cylindrical valve stems 4, which are offset from the center of each valve 12, 13. Each of these valve stems 4 fits slidably and rotatably into a cylindrical valve guide 2 which is machined or pressed into the cylinder head 1 in an offset position, so that the closed valve members 12, 13 match and cover the ports and seats on the valve seating area 17. The combustion chamber end of these valve guides 2 terminate a distance short of the valve seating area 17, and the opposite end of the guides 2 protrude into the area below the camshaft assembly 9 so that a valve guide seal 3 can be fitted to each of them. When the valve members 12,13 are in place in the valve guides 2, the valve stems 4 protrude a distance through the valve guide seals 3 fitted to the guides 2. Valve springs 7 are fitted over these valve stems 4, valve seals 3, and the protruding ends of the valve guides 2. The valve springs 7 are each captured by a follower 8 which is fitted slidably onto each valve stem 4. The followers 8 are registered to the valve stems 4 by flats 25 on the stems 4 and corresponding holes 24 with flats in the followers 8. A set screw 29 in the follower 8 secures the follower 8 to the valve stem 4. Referring now to FIGS. 1 and 5, a camshaft assembly 9 is fitted rotatably into camshaft bearings 5 in the cylinder head 1. It is captured by camshaft bearing caps 11 which are fastened to the cylinder head 1. This camshaft assembly 9 is located by the camshaft bearings 5 so that the cam segments 20 are in position to act on the followers 8 as the segments 20 rotate. The camshaft assembly 9 is driven in rotation by a chain or gear belt (not shown) which acts on the camshaft drive sprocket 10 which is fixed non-rotatably to the camshaft 19. The camshaft assembly 9 rotates at one-half crankshaft speed in a four-stroke-cycle engine and at crankshaft speed in a two-stroke-cycle engine. The chain or gear belt travels in an opening 18 in the cylinder head 1. With the camshaft assembly 9 in place, the follower driven pins 23 are engaged in the circumferential camshaft grooves 21 of the cam segments 20. The follower driven pins 23 have an axis a selected distance from the valve stem 4, providing leverage to rotate the valve stem 4 and associated valve member 12, 13. A nominal clearance between the follower 8 and the cam segment 20 is present when the radial camshaft protrusion 22 is not in contact with the follower 8. This clearance is adjusted by sliding the follower 8 to the necessary location on the valve stem 4 and then locking the follower 8 in place with the follower setscrew 29.

Figure 13:
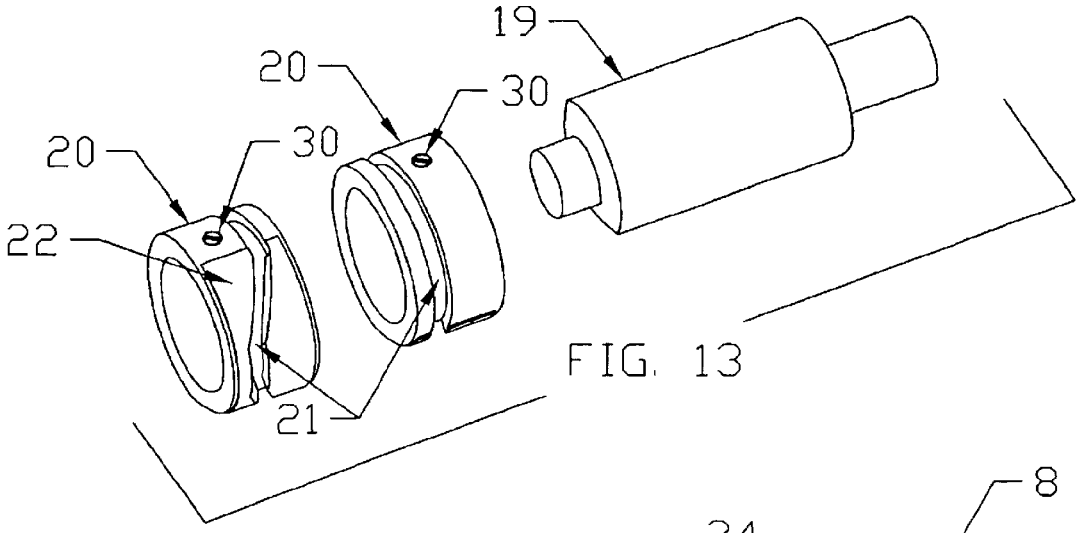
FIG. 13 is an exploded perspective view of the camshaft assembly showing the shaft, cam segments, and the setscrews which lock them in place on the shaft.
Figure 14:
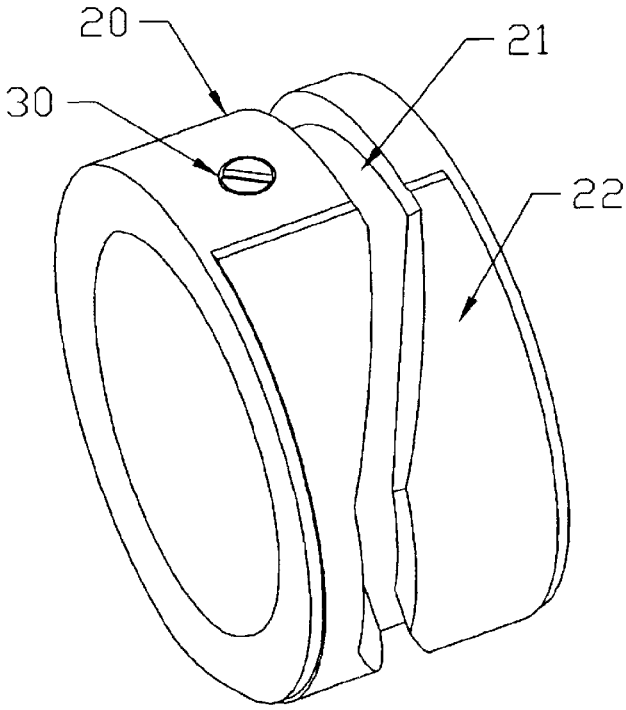
FIG. 14 is an enlarged perspective view of a cam segment showing a radial protrusion, circumferential groove, and the setscrew which locks the segment to the camshaft.
Figure 15:
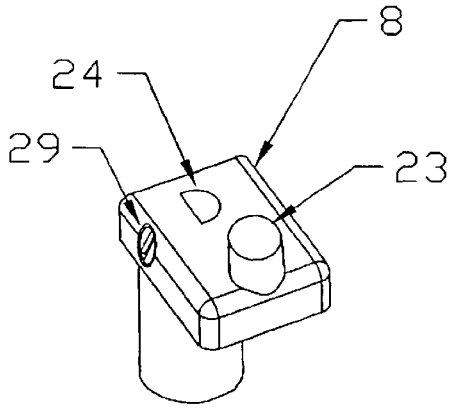
FIG. 15 is an enlarged perspective view of a follower showing the valve stem hole, driven pin, and the setscrew which locks the follower to the valve stem.

The camshaft assembly 9 is constructed such that adjustments can be made to alignment with the followers 8 and so that valve timing can be varied individually. The camshaft cam segments 20 fit slidably and rotatably onto the camshaft assembly shaft 19, as shown in FIG. 13. The cam segments 20 are moved to the desired locations on the camshaft assembly shaft 19, then locked in place by cam segment setscrews 30.

The function of this embodiment is as follows: A radial protrusion 22 on a cam segment 20 which is part of a camshaft assembly 9 rotating at one-half-crankshaft-rpm presses on a follower 8 which overcomes a spring 7 and lifts a valve member 12 or 13 a nominal distance from the valves seating surface 17. A circumferential groove 21 on the same cam segment then acts on the driven pin 23 of the follower 8 to rotate the valve member 12 or 13 to its fully open position. After a period of dwell, the circumferential groove 21 acting on the driven pin 23 of the follower 8 rotates the valve member 12 or 13 back to its closed position. The radial protrusion 22 then lowers the valve 12 or 13 back to its seated position on the valve seating area 17. As the camshaft assembly 9 rotates, the other valve member 12 or 13 is likewise actuated at the proper time to provide suitable charging and exhausting of the combustion chamber.

Figure 16:
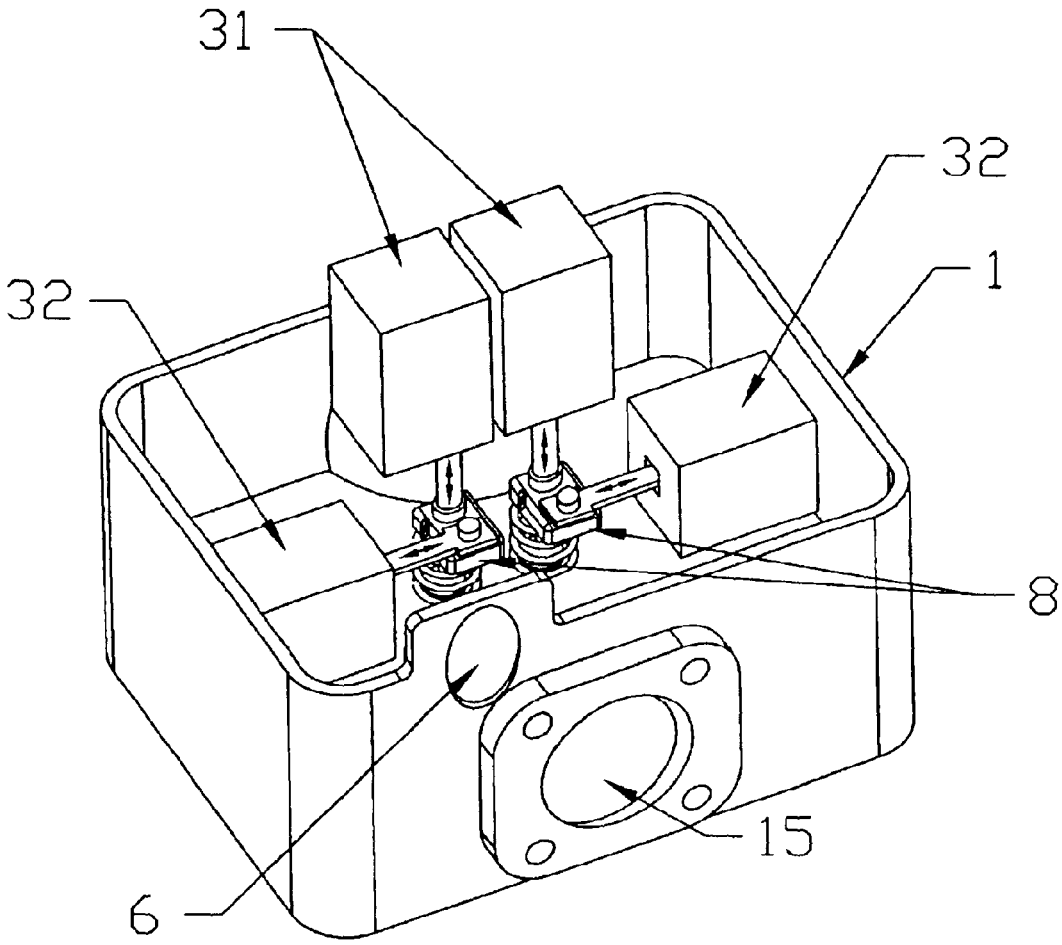
FIG. 16 is a perspective view of the top of the invention with electromechanical actuators shown in place of the camshaft assembly and its related mounts and drive chain/belt opening.

Alternatively, electromechanical means may be used to actuate the valve members 12, 13, replacing the camshaft assembly 9, camshaft bearings 5, camshaft bearing caps 11, and the camshaft drive sprocket 10. In this embodiment shown in FIG. 16, the followers 8 are pressed by valve lift actuators 31 which are mounted to the cylinder head 1, to lift the valve members 12, 13. Once the valve member 12 or 13 is lifted, the valve member 12, 13 is then rotated open and closed by a valve rotation actuator 32 mounted to the cylinder head 1, acting on the follower driven pin 23 of the follower 8. The valve 12 or 13 is then lowered by the valve lift actuator 31. As in the first embodiment, the valve members 12, 13 are actuated at the proper time to provide suitable charging and exhausting of the combustion chamber.

The cylinder head and valve system of the present invention is intended for use in place of the common and well known poppet valve cylinder head of internal combustion engines. Some details of the engine, such as the cylinder and piston, are equally well known and are therefore not shown or discussed in this construction. Provisions for cooling and for supplying lubricant to the camshaft, bearings, etc., while necessary in an actual working engine, are not shown or discussed in this description, as common methods such as coolant passages and oil pipes or passages are both well known and understood.

While the invention has been particularly shown and described with reference to preferred embodiments thereof, it will be understood by those skilled in the art that various changes in form and details may be made therein without departing from the spirit and scope of the invention.

I claim:

1. A valve system for charging and exhausting of combustion chambers of internal combustion engines including;

(a) a cylinder head adapted for securing to a multi-level combustion chamber, the cylinder head including asymmetrical ports which open into the combustion chamber on separate levels;

(b) each port controlled by a valve member larger than the port, the valve member of similar shape as the port, each valve member providing a flat sealing area for contacting the port periphery;

(c) each valve member having a non-centered cylindrical stem operatively traveling in a cylindrical valve guide sealed by a valve guide seal, each valve stem protruding through an end of the valve guide opposite the combustion chamber to locate a valve spring and accept a follower which captures the valve spring; and (d) each follower operatively associated with a valve operating camshaft assembly to selectively provide axial movement and rotational movement to each valve member and valve stem, the camshaft assembly including a cam shaft having a cam segment associated with each follower and valve member, the cam segment including a protrusion operating on the follower to provide axial movement of the valve member and valve stem, and a circumferential cam groove operating on a driven pin of the follower to provide rotational movement to the valve and valve stem;

(e) whereby the valve operating camshaft assembly first moves the valve member a nominal distance from the port periphery to unseal the port, then rotates the valve member in one direction to open the associated port, next rotates the valve member in an opposite direction to close the associated port, and finally moves the valve member a nominal distance to contact the port periphery and seal the port.

2. The valve system for charging and exhausting of combustion chambers of internal combustion engines of claim 1, wherein the cam segment is moveably secured to the cam shaft and secured thereto with at least one setscrew.

3. The valve system for charging and exhausting of combustion chambers of internal combustion engines of claim 1, wherein the ports are oriented to allow a single camshaft assembly to actuate the valves controlling the ports.

4. The valve system for charging and exhausting of combustion chambers of internal combustion engines of claim 1, wherein the follower and valve stem are mutually registered non-rotatably, and slidably fitted to each other with a locking means there between.

5. The valve system for charging and exhausting of combustion chambers of internal combustion engines of claim 1, wherein the valve stem further includes a flat surface and the follower includes a set screw contacting the valve stem flat surface, thereby adjustably securing the follower to the valve stem.

6. The valve system for charging and exhausting of combustion chambers of internal combustion engines of claim 1, wherein the following includes a driven pin, having an axis a selected distance from the valve stem, for engaging a circumferential cam groove of the valve operating assembly.

7. The valve system for charging and exhausting of combustion chambers of internal combustion engines of claim 1, wherein each valve seating area includes a seal fitted to the seating surface.

8. The valve system for charging and exhausting of combustion chambers of internal combustion engines of claim 7, further including a groove in the valve seating surface to accept the seal therein.

9. A valve system for charging and exhausting of combustion chambers of internal combustion engines including;

(a) a cylinder head adapted for securing to a multi-level combustion chamber, the cylinder head including asymmetrical ports which open into the combustion chamber on separate levels;

(b) each port controlled by a valve member larger than the port, the valve member of similar shape as the port, each valve member providing a flat sealing area for contacting the port periphery;

(c) each valve member having a non-centered cylindrical stem operatively traveling in a cylindrical valve guide sealed by a valve guide seal, each valve stem protruding through an end of the valve guide opposite the combustion chamber to locate a valve spring and accept a follower which captures the valve spring; and (d) each follower operatively associated with a valve operating actuator assembly to selectively provide axial movement and rotational movement to each valve member and valve stem, the actuator assembly comprising a plurality of electromechanical actuators operatively associated with each follower and valve member, one actuator providing axial movement to each valve member and valve stem, and another actuator providing rotational movement to each valve member and valve stem;

(e) whereby a first actuator first moves the valve member a nominal distance from the port periphery to unseal the port, then a second actuator rotates the valve member in one direction to open the associated port, next the second actuator rotates the valve member in an opposite direction to close the associated port, and finally the first actuator moves the valve member a nominal distance to contact the port periphery and seal the port.

10. The valve system for charging and exhausting of combustion chambers of internal combustion engines of claim 9, wherein the electromechanical actuators are solenoids.

11. The valve system for charging and exhausting of combustion chambers of internal combustion engines of claim 9, wherein the electromechanical actuators are solenoid-controlled pneumatic cylinders.

12. The valve system for charging and exhausting of combustion chambers of internal combustion engines of claim 9, wherein the follower and valve stem are mutually registered non-rotatably, and slidably fitted to each other with a locking means there between.

13. The valve system for charging and exhausting of combustion chambers of internal combustion engines of claim 9, wherein the valve stem further includes a flat surface and the follower includes a set screw contacting the valve stem flat surface, thereby adjustably securing the follower to the valve stem.

14. The valve system for charging and exhausting of combustion chambers of internal combustion engines of claim 9, wherein the follower includes a driven pin, having an axis a selected distance from the valve stem, for engaging the valve operating assembly.

15. The valve system for charging and exhausting of combustion chambers of internal combustion engines of claim 9, wherein each valve seating area includes a seal fitted to the seating surface.

16. The valve system for charging and exhausting of combustion chambers of internal combustion engines of claim 15, further including a groove in the valve seating surface to accept the seal therein.

* * * * *